US006024333A

United States Patent [19]

Raasch et al.

[11] Patent Number: 6,024,333

[45] Date of Patent: Feb. 15, 2000

[54] SHELF BRACKET FOR WIRE SHELVES

[75] Inventors: Jason J. Raasch, Arlington Heights; Andrey E. Frolov, Glenview, both of Ill.

[73] Assignee: Midwest Air Technologies, Inc., Lincolnshire, Ill.

[21] Appl. No.: 08/880,869

[22] Filed: Jun. 23, 1997

[51] Int. Cl.[7] ..... A47G 29/02

[52] U.S. Cl. ..... 248/247; 248/243; 211/90.03; 211/134

[58] Field of Search ..... 248/247, 246, 248/243, 250; 211/90, 134, 153, 106, 187, 90.03; 108/108

[56] References Cited

U.S. PATENT DOCUMENTS

| | | | |
|---|---|---|---|
| 476,520 | 6/1892 | Corscaden | 248/248 |
| 1,176,588 | 3/1916 | Miller et al. | 248/250 |
| 2,274,125 | 2/1942 | Carney | 211/153 |
| 3,207,100 | 9/1965 | Peacock | 248/248 |
| 3,321,089 | 5/1967 | Krikorian | 211/153 |
| 4,098,480 | 7/1978 | Neumann | 248/243 |
| 4,098,481 | 7/1978 | Johnson et al. | 248/243 |
| 4,533,056 | 8/1985 | Krikorian | 211/153 |
| 4,624,376 | 11/1986 | Bertram | 211/187 |
| 4,720,069 | 1/1988 | Bessinger | 248/250 |
| 4,783,035 | 11/1988 | Remmers | 248/250 |
| 5,346,077 | 9/1994 | Randall | 211/90 |

FOREIGN PATENT DOCUMENTS 939044 10/1963 United Kingdom .

*Primary Examiner*—Ramon O. Ramirez
*Assistant Examiner*—Gwendolyn Baxter
*Attorney, Agent, or Firm*—Greer, Burns, & Crain, Ltd.

[57] ABSTRACT

A bracket for a wire shelf having at least one of an inner rod, an outer rod and a middle rod, the bracket extending generally normally to the rods upon installation and including an elongate body having an inner end for mounting to a substrate bracket, an outer end opposite the inner end, and an upper edge. The upper edge is provided with at least one groove for accommodating a corresponding one of the inner, outer and middle rods, each groove having an inner curved wall closer to the inner end, an outer curved wall closer to the outer end, and a floor connecting the inner and outer curved walls, the outer curved wall being vertically displaced from the inner curved wall so that the floor is inclined from the inner curved wall to the outer curved wall.

19 Claims, 5 Drawing Sheets

10
12
14
16
22
24
26
28
30
32
34
36
38
40
42
44
46
48
50
52
54
56
58
62
64
D
G
X
Z 10
22
24
26
28
30
32
34
36
38
40
42
44
46
48
50
52
54
56
58
62
64
D
F3
F4

$F_5$

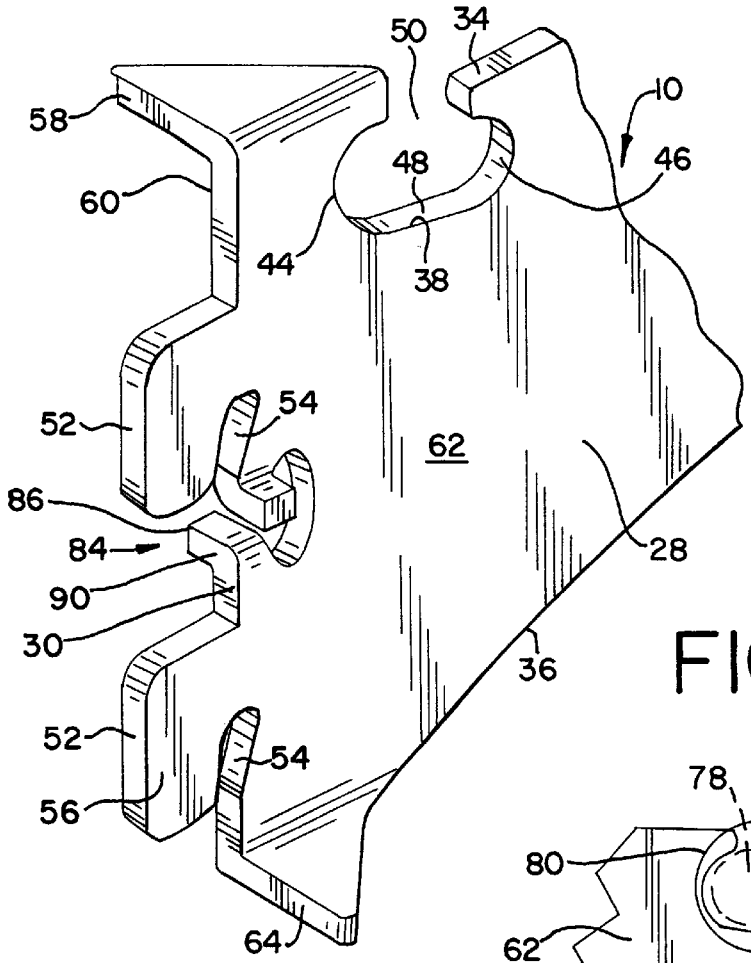
FIG. 7
FIG. 11
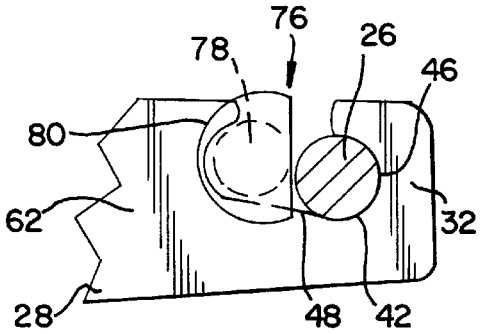
FIG. 9
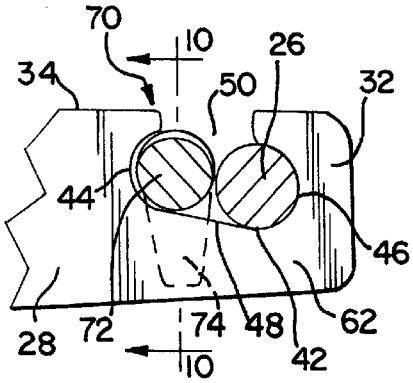
FIG. 10
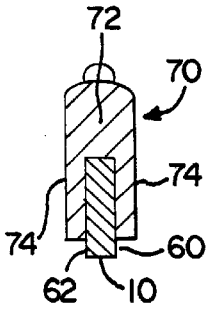
FIG. 12
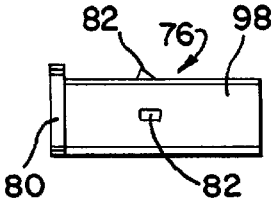

SHELF BRACKET FOR WIRE SHELVES

BACKGROUND OF THE INVENTION

The present application relates generally to wall-mounted, cantilever type shelf brackets, and specifically to such brackets which are used with wall-mounted slotted wall supports to support ventilated shelves made of metallic wire.

While for many years such wire shelving was strictly used in refrigerators, freezers, and in commercial establishments, recent years have seen a significant increase in the use of wire shelving for residential applications, particularly for closets and kitchen pantries. The increased popularity of such shelving is due in part to its ease of adaptation to a wide variety of storage applications and closet sizes. In a typical application, the shelves are supported by cantilever brackets which adjustably engage vertical slots in wall supports which are secured to the wall. Each of the brackets has at least one hook-like tab which engages the slots at a height designated by the user.

One problem of conventional ventilated or wire shelves of the type used with standard vertical wall supports, is that the wire shelves are somewhat unstable in their supporting brackets. This instability is particularly problematic when the forward edge of the shelf is loaded disproportionately to the rear portion of the shelf. An imbalanced condition is thus created, which promotes the tendency of the rear edge of the shelf to disengage from the cantilever bracket and flip upward. As such, conventional wire shelves have a tendency to become disengaged from the bracket, and sometimes spill their contents. Such situations may cause personal injuries and/or property damage.

One attempted solution to this problem of instability is addressed in U.S. Pat. No. 5,346,077. There, the bracket was provided with a plurality of nesting receptacles for accommodating the transverse rods of a typical wire shelf. In addition, a locking lip located near the rearmost or inner rod prevents the shelf from flipping up in the rear. However, a drawback of this design is that in instances when the shelf is lightly loaded and receives an impact directed generally horizontally toward the rear of the shelf, or from beneath the shelf, such as from inadvertent bumping by a user, the design of the patented bracket is such that the shelf may still become easily disengaged and cause injury or damage.

Another problem of conventional cantilever brackets for wire shelves is that the generally plate-like construction of the bracket creates a pivot point where the bracket engages the wall support, which becomes more unstable as the length of the bracket increases. As a result, conventional brackets have the tendency to move in a side-to-side manner.

Accordingly, a first object of the present invention is to provide an improved shelf bracket for wire shelves in which the wire shelf is securely retained in the bracket.

Another object of the present invention is to provide an improved shelf bracket for wire shelves in which the bracket retains the shelf even upon impacts which are directed from the front in a horizontal plane, or from beneath the shelf.

Yet another object of the present invention is to provide an improved shelf bracket for wire shelves in which the bracket is provided with integral formations for increasing lateral stability.

Still another object of the present invention is to provide an improved shelf bracket for wire shelves which features supplemental locking inserts which are used to lock at least one of the shelf rods in a corresponding one of the bracket slots.

SUMMARY OF THE INVENTION

The above-listed objects are met or exceeded by the present shelf bracket for wire shelves, in which the upper edge of the bracket is provided with a plurality of slots configured for accommodating the corresponding transverse rods of a typical wire shelf. Each of the slots is provided with curved inner and outer walls to retain the rods even when they are inadvertently pushed backward or upward. In addition, the rear or inner curved wall is disposed higher than the front or outer curved wall of each slot to further retain the rod upon such inadvertent impacts. In addition, the present bracket features a variety of integral stabilizer formations for maintaining lateral stability. Another feature of the present bracket is the inclusion of locking inserts for releasably retaining at least one of the shelf rods in a corresponding slot in each bracket.

More specifically, the present package provides a bracket for a wire shelf having at least one of an inner rod, an outer rod and a middle rod, the bracket extending generally normally to the rods upon installation. Included in the bracket is an elongate body having an inner end for mounting to a substrate bracket, an outer end opposite the inner end, and an upper edge. The upper edge is provided with at least one groove for accommodating a corresponding one of the inner, outer and middle rods, each groove having an inner curved wall closer to the inner end, an outer curved wall closer to the outer end, and a groove floor connecting the inner and outer curved walls. In the preferred embodiment, the outer curved wall is vertically displaced from the inner curved wall so that the groove floor is inclined from the inner curved wall to the outer curved wall.

In another embodiment, the present invention provides a bracket for a wire shelf having at least one of an inner rod, an outer rod and a middle rod, the bracket extending generally normally to the rods upon installation and including an elongate body having an inner end for mounting to a substrate bracket, and an outer end opposite the inner end. The inner end is provided with a retaining flange disposed at an upper edge of the bracket which projects from a first side of the bracket, and a lower flange projecting from a second side of the bracket.

BRIEF DESCRIPTION OF THE DRAWINGS

FIG. 7 is a fragmentary perspective view of the bracket of FIG. 6;

FIG. 9 is a fragmentary side elevational view of the bracket of FIG. 1 shown with an optional locking attachment;

FIG. 10 is a sectional view taken along the line 10—10 of FIG. 9 and in the direction indicated generally;

FIG. 11 is a fragmentary side elevational view of an alternate embodiment of the optional locking insert of FIG. 9;

FIG. 12 is a front elevational view of the locking insert shown in FIG. 11;

DETAILED DESCRIPTION OF THE PREFERRED EMBODIMENT

Figure 1:
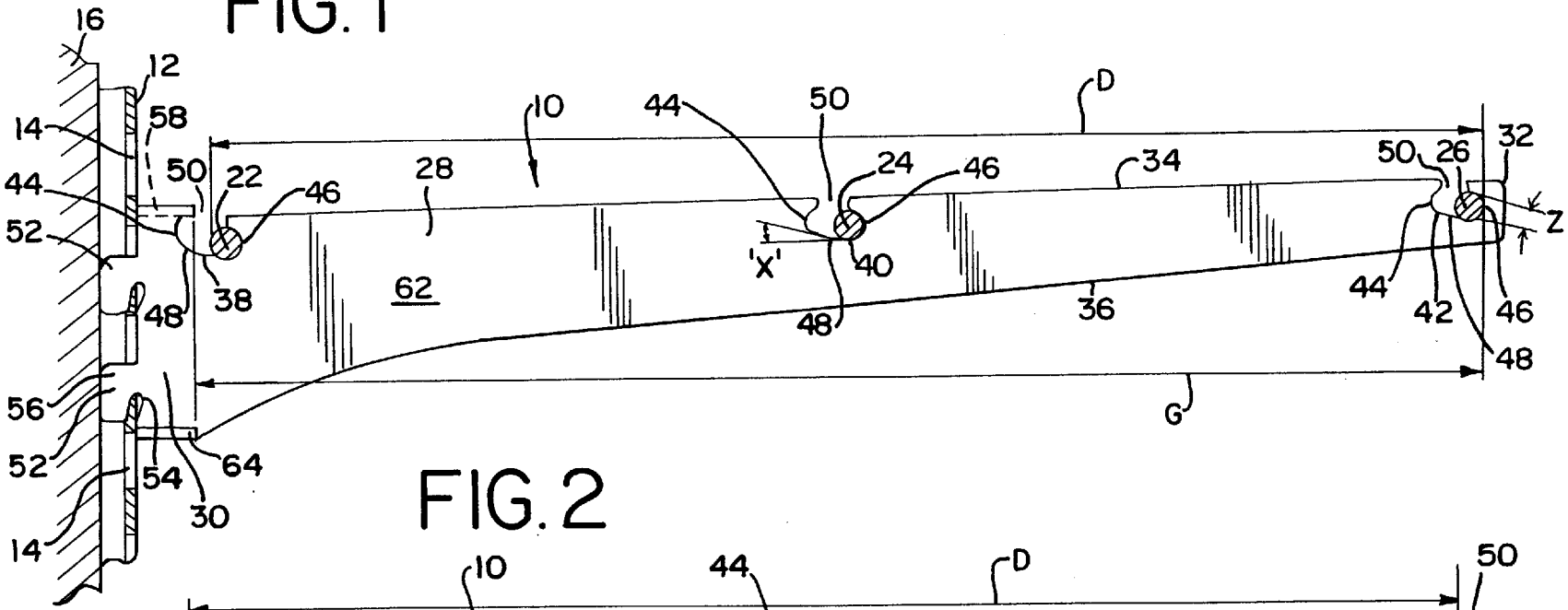
FIG. 1 is a side elevational view of the present bracket with the shelf shown in a normal operating position.
Figure 2:
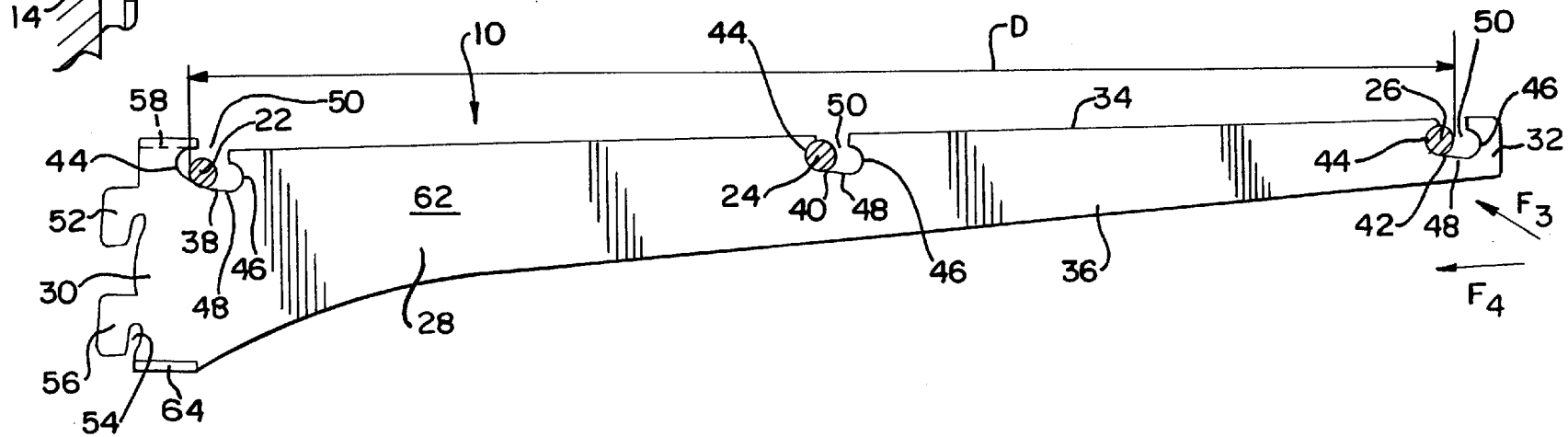
FIG. 2 is a side elevational view of the bracket of FIG. 1 shown after the shelf is subject to a horizontal force directed inwardly.
Figures 3, 4, 5, 6, 8:
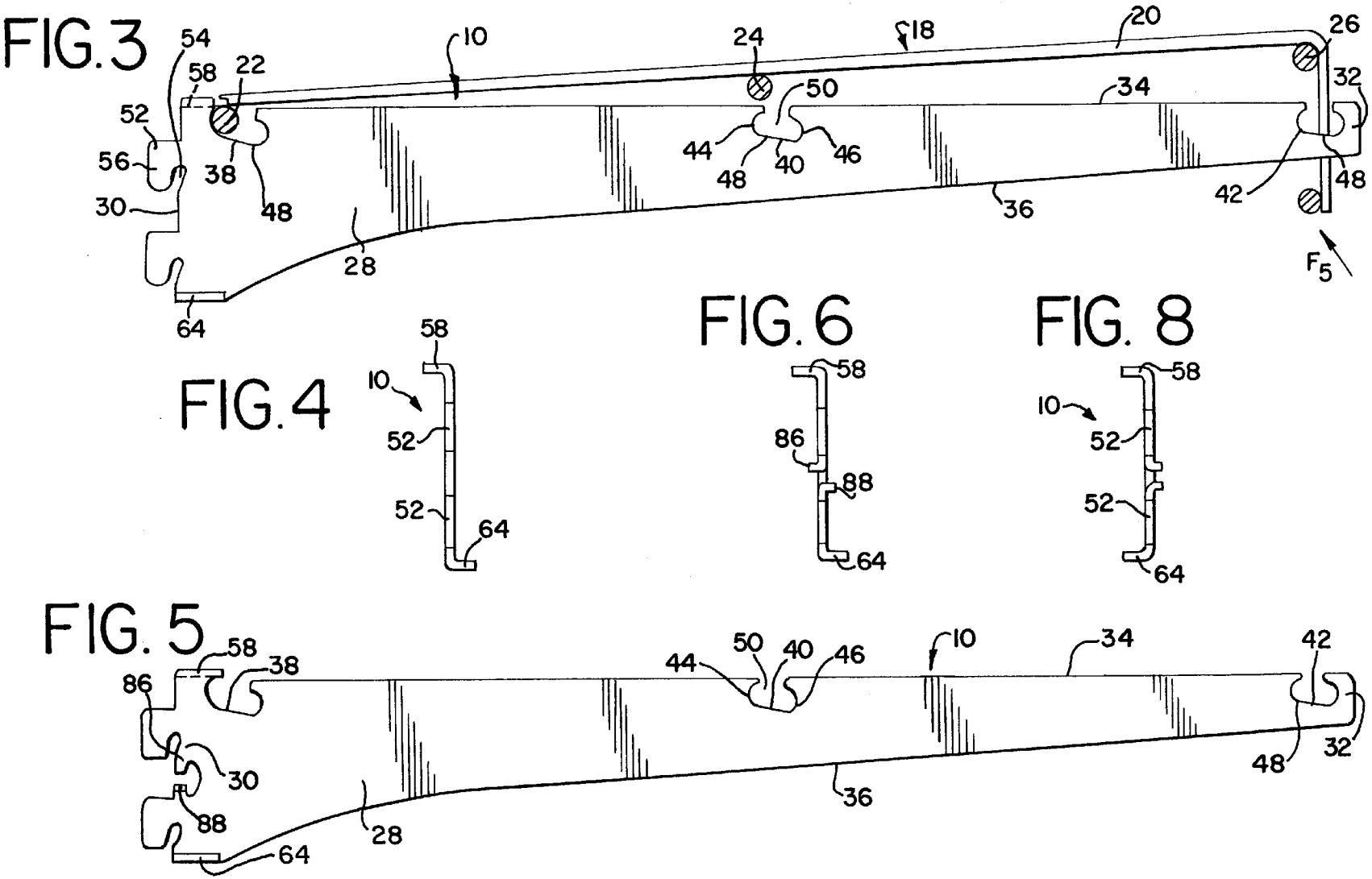
FIG. 3 is a side view of the present bracket showing the wire shelf being installed thereon.
FIG. 4 is a rear view of the shelf bracket of FIG. 1.
FIG. 5 is a side elevational view of an alternate embodiment of the bracket of FIG. 1.
FIG. 6. is a rear view of the bracket of FIG. 5.
FIG. 8 is a rear view of an alternate embodiment to the bracket of FIG. 6.

Referring now to FIGS. 1, 2 and 3, the bracket of the invention is generally designated 10, and is intended for engagement with a substrate or wall-mounted bracket 12 provided with a plurality of vertically oriented and spaced slots 14. As is well known in the art, the bracket 12 is mounted to a wall or substrate 16 using fasteners such as threaded screws, anchors, toggle bolts or equivalent fasteners. Once installed in the wall mount bracket 12, the shelf bracket 10 creates a cantilever support for a wire shelf. generally designated 18 (best seen in FIG. 13).

The wire shelf 18 includes a plurality of generally parallel, spaced load rods 20 (only one shown in FIG. 3) which project generally parallel to the bracket 10, and which are all attached to transverse support rods which extend generally normally to the installed bracket 10. In the present invention, the shelf 18 is preferably of the type having three such support rods, designated the inner support rod 22, the middle support rod 24, and the outer support rod 26. It will be understood, however, that the middle support rod 24 is preferred, but is not required.

Included on the bracket 10 is an elongate, generally laterally flattened, bar-like body 28 having an inner end 30 for mounting to a substrate bracket, an outer end 32 opposite said inner end, an upper edge 34 and a lower edge 36. It will be seen that the inner end 30 generally corresponds to the inner support rod 22, and that the outer end 32 generally corresponds to the outer support rod 26 of the shelf 18.

At least one, and preferably three grooves 38, 40, 42, designated inner, middle and outer grooves, respectively, are configured for accommodating a corresponding one of the inner, middle and outer rods, 22, 24, 26. Each groove 38, 40, 42 has an inner curved wall 44 disposed closer to the bracket inner end 30, an outer curved wall 46 disposed closer to the outer end 32, and a groove floor 48 connecting the inner and outer curved walls. It will be seen that the outer curved wall 46 is convex or bulges toward the outer end 32, and the inner curved wall 44 bulges or is convex toward the inner end 30. From FIGS. 1 and 2 it is also apparent that the outer curved wall 46 is lower than the inner curved wall 44, and this is because the groove floor 48 is inclined from the inner curved wall to the outer curved wall at an angle "x" (best seen in FIG. 1). The advantages of this inclination of the floor 48 are described in greater detail below.

In appearance, the middle and outer grooves 40, 42 are more similar in appearance to each other than to the inner groove 38, in which the inner curved wall 44 has a greater radius and is larger overall. This configuration is designed to facilitate the insertion of the shelf 18 into the bracket 10, and acts as a locator for the inner support rod 22. In all of the grooves, 38, 40, 42, the outer curved wall 46 is provided with an angle "z" (best seen in FIG. 1) which approximates the diameter of the corresponding support rod 22, 24, 26, and defines an angle which in the preferred embodiment is in the range of 10°–15°. As such, once the shelf 18 is in position in the bracket 10, the support rods 22, 24, 26 will be securely retained by the corresponding grooves 38, 40, 42.

Each of the grooves 38, 40, 42 is also provided with an entrance gap 50 located along the upper edge 34. In length, each such gap 50 is long enough to accommodate one of the corresponding support rods 22, 24, 26. In addition, the gap is shorter in length than the groove floor 48, to discourage the shelf 18 from becoming inadvertently disengaged from the bracket 10.

Referring now to FIG. 1, outer peripheries of the inner and outer rods 22, 26 are separated by a first distance D, and an outermost point of the inner curved wall 44 of the inner groove 38 and the outer curved wall 46 of the outer groove 42 define a second distance G. In the preferred embodiment, the distance G is greater than the distance D. This disparity in distances, which is preferably slight, allows the shelf 18 to be more easily inserted into the corresponding grooves of the bracket 10, yet also facilitates the retention of the shelf in the bracket during normal use.

Referring now to FIGS. 1, 3 and 7, the inner end 30 of the bracket 10 is preferably provided with a pair of inwardly projecting mounting hooks 52 for engaging the slots 14 in the wall mount bracket 12. A slightly angled slot 54 is defined by a tab-like head 56 of each of the hooks 52, for tightly engaging the wall mount bracket 12. Preferably two such hooks 52 are provided in vertically spaced orientation to each other, however it is contemplated that the number and spacing of the hooks 52 may vary depending on the application and the type of wall mount bracket used.

Also provided at the inner end 30 is a retaining flange 58 which at least partially covers the inner groove 38, and which projects toward one of a left side 60 and a right side 62 of the bracket 10. In the preferred embodiment, the flange 58 is generally triangular-shaped when viewed from above, and is configured for providing lateral stability to the bracket upon engagement in the wall mount bracket 12. One of the shorter legs of the triangle abuts the wall mount bracket 12 to stabilize the bracket 10. However, other shapes for the flange 58 are contemplated depending on the application.

Additional lateral stability to the inner end 30 of the bracket 10 is provided by a lower flange 64 which projects from an opposite side of the bracket from the retaining flange 58 (best seen in FIG. 7). As is the retaining flange 58, the lower flange 64 is preferably generally triangular in shape when viewed from above, with one side of the triangle being disposed along a front surface of the wall mount bracket 12. Thus, in the preferred embodiment, the flanges 58, 64, being located on opposite sides of the bracket 10, cooperate in providing lateral stability to the bracket regardless of the direction of the lateral force which may cause the pivoting action.

Another function of the retaining flange 58 is that it partially defines the entrance gap 50 of the inner slot 38. As such, the retaining flange 58 thus blocks the unwanted disengagement of the shelf 18 from the bracket 10, which occurs when the shelf is subject to impact from below, as represented by the force F5 in FIG. 3. It will be seen that even though the impact has dislodged the shelf from the outer and middle slots 42, 40, the retaining flange 58 will still maintain the engagement of the shelf 18 with the bracket 10.

Referring now to FIGS. 1 and 2, a significant advantage of the present shelf bracket 10 is that the shelf 18 is more securely retained by the bracket, and inadvertent impacts upon the shelf 18 are accommodated by the configuration of the inner curved walls 44 and the inclined grooved floors 48. FIG. 1 depicts the bracket 10 and the shelf 18 in the normal position, with the rods 22, 24, 26 engaged in the corresponding grooves 38, 40, 42 by contacting the adjacent outer curved walls 46. Due to the inclination of the groove floors 48, the shelf will naturally settle toward the outer curved walls 46, and the addition of weight to the shelf will more securely retain the shelf in this position. Thus, when loaded, the shelf will become "self-locking" in the bracket 10. The size of the angle "z" of the outer curved walls 46 will also assist in the shelf retention by frictionally engaging the corresponding, similarly dimensioned, support rods 22, 24, 26.

Upon an upward or rearward impact, as depicted by the force vectors F3 and F4, respectively in FIG. 2, the shelf 18 is displaced slightly upward and backward, however this displacement is controlled by the angle of inclination of the groove floor 48, and also by the shape of the grooves 38, 40, 42 and their engagement with the corresponding rods 22, 24, 26. The curved shape of the inner curved walls 44 frictionally engages the rods 22, 24 and 26 and prevents them from becoming disengaged from the bracket 10, resulting in a safer shelf and bracket assembly. Upon removal of the impact forces represented by the vectors F3 and F4, the shelf 18 will return to its original position depicted in FIG. 1.

Referring now to FIGS. 9 and 10, an optional feature of the bracket 10 is the inclusion of at least one locking insert, generally designated 70, for retaining, either by friction or by the weight of the insert, a corresponding one of the rods 22, 24, 26 in the corresponding groove 38, 40, 42. In the preferred embodiment, the inserts are made of plastic or metal, and are generally "U"-shaped when viewed in cross-section (best seen in FIG. 10). Generally, the inserts 70 are configured to straddle the bracket 10 in the grooves 38, 40, 42 to occupy the space in the groove not occupied by the respective rod 22, 24, 26. In this manner, the rods, and of course the shelf 18, will be prevented from unwanted movement along the longitudinal axis of the bracket 10.

More specifically, each of the inserts 70 includes a central, generally cylindrical portion 72 provided on each end with a depending leg 74. It is contemplated that the portion 72 may, as an alternative to cylindrical, be conical or some other shape, as long as the extra space in the groove is occupied to hold the rod in place. Preferably, the cylindrical portion 72 has a length which approximates the thickness of the bracket 10, so that the legs, 74 snugly engage the sides 60, 62 of the bracket. In the case of metal inserts 70, in some applications the mere weight of the insert will hold it in the groove without requiring a friction fit.

For applications where the inserts 70 are employed, the user merely installs the shelf 18 in the bracket, then slides at least one insert into a corresponding groove on at least one bracket supporting a given shelf 18. Additional inserts are not required for locking the shelf in place, but their use is contemplated. To remove or adjust the shelf 18, the process is merely reversed.

Referring now to FIGS. 11 and 12, an alternate embodiment of the insert is generally designated 76, and includes a generally cylindrical portion 78 dimensioned to fit within the groove 38, 40, 42 just as is the case with the insert 70. At one end of the cylindrical portion 78 is disposed a head 80, which is larger in diameter than the cylindrical portion and as such engages one of the sides 60, 62 of the bracket 10 in the same way as one of the legs 74 of the insert 70. Also provided to the cylindrical portion 78 is at least one barb formation 82 which projects radially from the generally cylindrical portion to releaseably lock the insert 76 in the corresponding groove 38, 40, 42. The barb formations 82 engage the opposite side 60, 62 from that engaged by the head 80.

Referring now to FIGS. 5–8, another optional feature of the present bracket 10 is the provision of at least one lateral stability tab, generally designated 84, for providing additional support against lateral movement of the bracket 10 when engaged in the wall mount bracket 12. In the preferred version of this embodiment, which is designed for heavier duty applications, and referring now to FIGS. 5–7, in addition to the retaining flange 58 and the lower flange 64, there are two stability tabs 84, each being integrally formed in the bracket 10 and each having a corresponding portion 86, 88 projecting towards a respective side 60, 62 of the bracket 10.

The portions 86, 88 are constructed and arranged so that an inner side 90 (best seen in FIG. 7) engages a front surface of the wall mount bracket 12 to provide the desired additional stability. In the preferred version of this embodiment, the stability tabs 84 are disposed generally between the retaining flange 58 and the lower flange 64, and are stamped and formed in the inner end 30 of the bracket. However, it is contemplated that other locations and manufacturing techniques could be employed to create the tabs.

Referring now to FIG. 8, alternately, the portions 86, 88 can be formed so that both project from the same side 60, 62 of the bracket 10. In that embodiment, it is preferred that the retaining flange 58 and the lower flange 64 project from the same side 60, 62, which is opposite the side from which the portions 86, 88 project.

Figure 13:
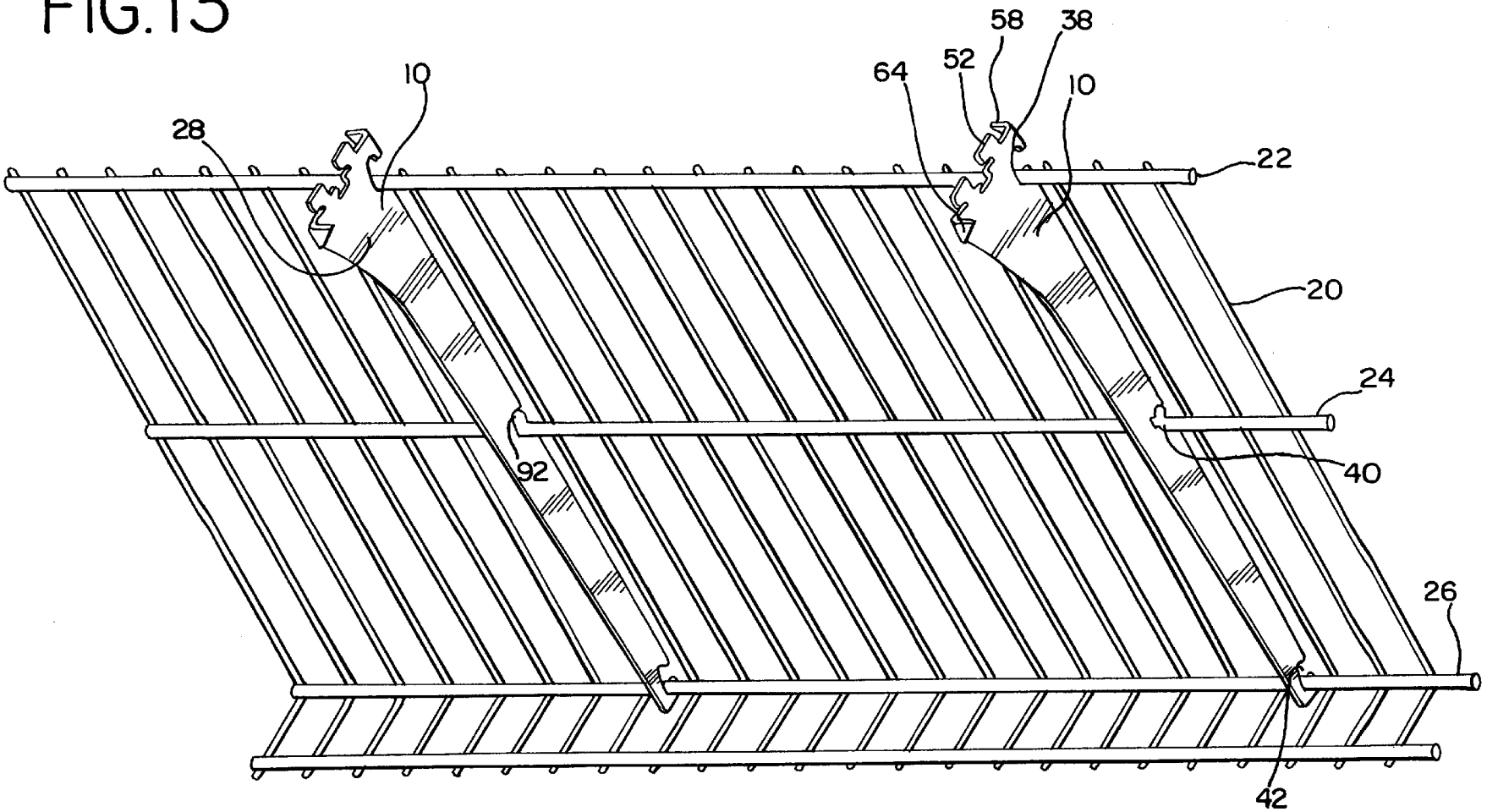
FIG. 13 is a perspective elevational view of two of the the present shelf brackets assembled with a shelf,and viewed from below.
Figure 14:
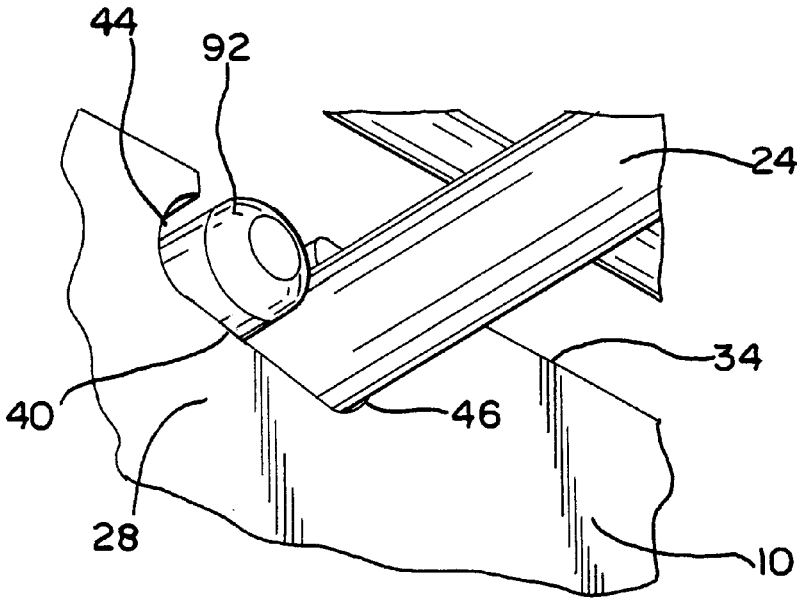
FIG. 14 is an enlarged fragmentary perspective view of FIG. 13 showing the use of an optional locking insert.
Figure 15:
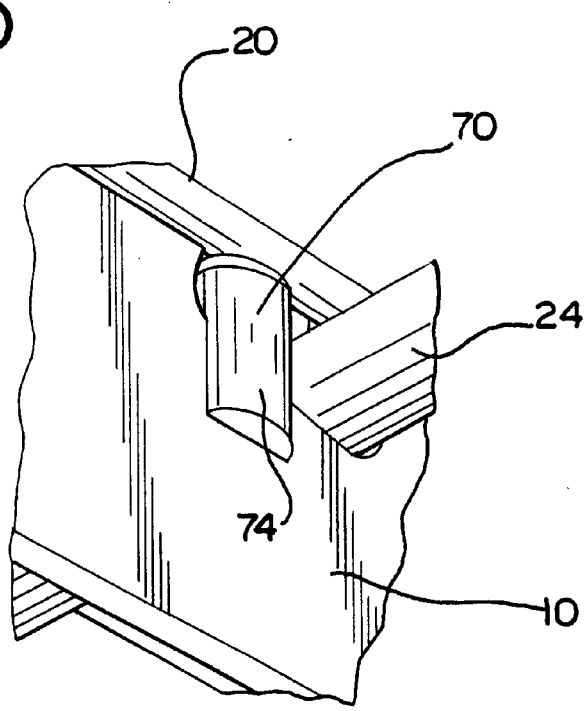
FIG. 15 is an enlarged fragmentary perspective view of FIG. 13 showing the use of another optional locking insert.

Referring now to FIGS. 13–15, a pair of the present shelf brackets 10 is depicted assembled with a shelf 18, and using one of the optional locking inserts 70 (FIG. 15) and a variant dowel-shaped insert 92 (FIG. 14) in corresponding middle grooves 40.

Thus, it will be seen that through the configuration of the grooves 38, 40, 42, the present bracket 10 features the ability to securely retain a wire shelf 18 in the face of impacts from a variety of directions. The optional locking inserts 70, 76 provide additional assurance to the user that the shelf 18 will be securely restrained within the bracket 10. Also, the provision of the flanges 58, 64 and the retaining tabs 84 add lateral stability to the bracket 10 and to the shelf assembly 10, 12, 18 as a whole.

While a particular embodiment of the shelf bracket for wire shelves of the invention has been shown and described, it will be appreciated by those skilled in the art that changes and modifications may be made thereto without departing from the invention in its broader aspects and as set forth in the following claims.

What is claimed is:

1. A bracket for use with a wire shelf having at least one of an inner rod, an outer rod and a middle rod, said bracket extending generally normally to the rods upon installation and comprising:

an elongate body having an inner end for mounting to a wall mount bracket, an outer end opposite said inner end, and an upper edge;

said upper edge being provided with at least one groove for accommodating a corresponding one of the inner, outer and middle rods of the shelf, said at least one groove having an inner curved wall closer to said inner end, an outer curved wall closer to said outer end, and a floor connecting said inner and outer curved walls, said outer curved wall being vertically displaced from said inner curved wall so that said floor is inclined from said inner curved wall to said outer curved wall and relative to said upper edge of said body such that due to the inclination of said floor, upon insertion of the shelf rods into said at least one groove, at least one of the rods will naturally settle to an engagement with a corresponding said outer curved wall;

said inner curved wall of said at least one groove is configured such that, upon the exertion of an inwardly directed lateral force on the shelf, the corresponding inner and outer rods are displaceable from their position against said outer curved wall, and are forced up said floor to be pushed against, and retained by, said corresponding inner curved wall of said corresponding inner and outer at least one groove.

2. The bracket as defined in claim 1 further including an entrance gap in said at least one groove for accommodating one of said corresponding rods.

3. The bracket as defined in claim 2 wherein said gap is shorter in length than said groove floor.

4. The shelf bracket as defined in claim 1 further including two such grooves, an inner groove, and an outer groove, said inner groove at least partially covered by a retaining flange.

5. The shelf bracket as defined in claim 4 wherein said retaining flange is disposed on said upper edge of said elongate body, projects toward one of a left and right side of said bracket, and is configured for providing lateral stability to said bracket upon engagement in said wall mount bracket.

6. The shelf bracket as defined in claim 5 further including a lower flange on said bracket at said inner end which projects toward an opposite side of said bracket from said retaining flange.

7. The shelf bracket as defined in claim 4 wherein said retaining flange at least partially defines an entrance gap for said inner groove.

8. The shelf bracket as defined in claim 1 wherein the corresponding inner and outer rods of the shelf are separable by a first distance, and said inner curved wall of an inner groove and said outer curved wall of an outer groove define a second distance, wherein said second distance is greater than said first distance.

9. The shelf bracket as defined in claim 1 further including at least one locking insert for retaining a corresponding one of the rods in said corresponding groove.

10. The shelf bracket as defined in claim 9 wherein said locking insert is generally U-shaped in cross-section to engage said bracket.

11. The shelf bracket as defined in claim 9 wherein said locking insert is generally cylindrical with a head at one end, and at least one barb formation for retaining said insert in said corresponding groove.

12. The shelf bracket as defined in claim 1 further including at least one lateral stability tab provided at said inner end.

13. The shelf bracket as defined in claim 12 further including a pair of sad lateral stability tabs, each said tab projecting to a corresponding side of said bracket.

14. A bracket for a wire shelf having at least one of an inner rod, an outer rod and a middle rod, said bracket extending generally normally to said rods upon installation and comprising:

an elongate body having an inner end for mounting to a substrate bracket, an outer end opposite said inner end, and an upper edge;

said upper edge being provided with at least one groove for accommodating a corresponding one of the inner, outer and middle rods of the shelf; and said inner end being provided with a retaining flange disposed at an upper edge of said bracket, said retaining flange projecting from a first side of said bracket and configured for providing lateral stability to said shelf bracket upon engagement in the substrate bracket and at least partially covering said inner groove, and a lower flange projecting from a second side of said bracket.

15. The shelf bracket as defined in claim 14 further including at least one lateral stability tab projecting from one of said sides at said inner end.

16. The shelf bracket as defined in claim 15 wherein said at least one lateral stability tab is disposed generally between said retaining flange and said lower flange.

17. The shelf bracket as defined in claim 15 further including a pair of said lateral stability tabs each said tab projecting from a corresponding side of said bracket.

18. The shelf bracket as defined in claim 14 wherein said at least one groove has an inner curved wall closer to said inner end, an outer curved wall closer to said outer end, and a floor connecting said inner and outer curved walls, said outer curved wall being lower than said inner curved wall so that said floor is inclined from said inner curved wall to said outer curved wall.

19. A shelf bracket for use with a wire shelf having at least one of an inner rod, an outer rod and a middle rod, said bracket extending generally normally to the rods upon installation, being mountable to a substrate bracket and comprising:

an elongate body having an inner end for mounting to the substrate bracket, an outer end opposite said inner end, and an upper edge; and said inner end being provided with a retaining flange disposed at said upper edge of said shelf bracket, projecting from a first side of said shelf bracket and configured for providing lateral stability to said shelf bracket upon engagement of said flange with the substrate bracket, a lower flange projecting from a second, opposite side of said shelf bracket and in an opposite direction, said retaining flange forming a plane approximately parallel with said upper edge of said shelf bracket.

* * * * *